United States Patent [19]

Nishimura et al.

[11] Patent Number: 4,704,963

[45] Date of Patent: Nov. 10, 1987

[54] DEVICE FOR CLEANING A TYPE-CARRIER

[75] Inventors: Hiroshi Nishimura; Masao Miyasaka, both of Ibaraki, Japan

[73] Assignee: Hitachi Koki Company, Limited, Tokyo, Japan

[21] Appl. No.: 794,031

[22] Filed: Nov. 1, 1985

[30] Foreign Application Priority Data

Nov. 2, 1984 [JP] Japan ..... 59-167082[U]

[51] Int. Cl.[4] ..... B41L 41/00; B41J 1/20; H46B 17/00

[52] U.S. Cl. ..... 101/425; 101/423; 101/93.13; 400/146; 400/702.1; 15/21 D; 15/257 A

[58] Field of Search ..... 101/105, 111, 423, 425, 101/93.13; 15/21 D, 21 R, 77, 257 A; 400/146, 701, 702, 702.1

[56] References Cited

U.S. PATENT DOCUMENTS

| | | | |
|---|---|---|---|
| 1,240,631 | 9/1917 | Trier | 101/425 X |
| 2,752,271 | 6/1956 | Walkup et al. | 15/257 A X |
| 2,844,123 | 7/1958 | Hayford | 101/425 X |
| 3,309,993 | 3/1967 | Grembecki et al. | 101/425 |
| 3,604,239 | 9/1971 | Moxon | 15/257 A X |
| 3,659,526 | 5/1972 | Staller | 15/257 A X |
| 4,015,307 | 4/1977 | Kossak | 101/425 X |
| 4,216,714 | 8/1980 | Ackley, Sr. et al. | 101/425 X |

FOREIGN PATENT DOCUMENTS

| | | | |
|---|---|---|---|
| 243851 | 2/1912 | Fed. Rep. of Germany | 101/425 |
| 620638 | 10/1935 | Fed. Rep. of Germany | 101/425 |
| 54337 | 10/1910 | Switzerland | 15/21 D |

OTHER PUBLICATIONS

IBM Tech. Disc. Bulletin, "Print Chain Brush Cleaner", Baker et al., vol. 15, No. 9, Feb. 1973, p. 2805.

Xerox Disc. Journal, "Camming Cleaner/Film", Trainor, vol. 2, No. 1, Jan./Feb. 1977, p. 65.

Xerox Disc. Journal, "Brush Cleaner-Contoured Air Flow Baffles", Barione, vol. 4, No. 3, May/Jun. 1979, pp. 405-406.

Xerox Disc. Journal, "Pre-Nip Vacuum Assisted Brush Cleaning System", Borostyan et al., vol. 4, No. 6, Nov./Dec. 1979, pp. 799-800.

*Primary Examiner*—Edgar S. Burr

*Assistant Examiner*—James R. McDaniel

*Attorney, Agent, or Firm*—Sughrue, Mion, Zinn, Macpeak & Seas

[57] ABSTRACT

A device for cleaning a rotary type-carrier, in which a brush which contacts the type-carrier continuously to clean it during normal operation may be moved so that its rotary center is positioned more closely to the type-carrier. As a result, as the brush wears out, it may maintain contact with the type-carrier, obviating the need for frequent replacement.

10 Claims, 5 Drawing Figures

DEVICE FOR CLEANING A TYPE-CARRIER

BACKGROUND OF THE INVENTION

The present invention relates to a device for cleaning a type-carrier, such as, for example, a type-carrying belt or the like which travels horizontally.

In a printer of the impact type using an ink ribbon, dust or the like from the ink ribbon may be caught among individual typing elements on a type-carrying belt, causing deterioration in printing quality. Therefore, it is necessary to clean the type-carrying belt. There has been proposed a device having a brush which is positioned opposite one of pulleys for driving the type-carrying belt and which is rotated while touching the belt, in order to clean it.

Since the brush touches the type-carrying belt, the brush may be worn out under long use and becomes unable to touch the type-carrying belt, so that the brush's cleaning ability become impaired. To compensate for this deficiency, the brush must be replaced frequently. Further, since the type-carrying belt is between one of the pulleys and the brush, there has been a further problem that the attachment and removal of the type-carrying belt is troublesome, and attaching and detaching workability of the belt is poor. Furthermore, a special arrangement has been required for preventing the one pulley from getting dirty with dust from the ink ribbon or the like, because the brush may touch the outer periphery of the one pulley when the type-carrying belt is removed.

SUMMARY OF THE INVENTION

To solve the above-mentioned problems, it is an object of the present invention to lengthen the period of replacement of the brush, and to improve ease of attachment and removal of the type-carrier.

According to the present invention, the mounting position of the brush is changed as the brush wears, so that contact between the brush and the type-carrier is maintained. Consequently, the structural relation among a rotary shaft on which the brush is mounted, a suction hood, a collar, and the like has been devised.

The present invention resides in a type-carrier cleaning device having a type-carrier supported by at least two pulleys so as to be able to turn thereabout, a brush provided opposite one of the pulleys so as to touch and clean the type-carrier, and a suction hood for rotatably supporting the brush. The device according to the present invention comprises a rotary shaft passed through the suction hood and rotatably supported by the suction hood, the rotary shaft having an eccentric shaft on which the brush is mounted, a collar fitted by screw means to a bottom end of the rotary shaft projecting down from a bottom portion of the suction hood, and a plurality of engagement/locking slots formed at a periphery of a hole provided in the suction hood and passed throuqh by the rotary shaft. The device further comprises an engagement/locking member formed on one of the rotary shaft and collar for engaging with one of the engatement/locking slots to thereby prevent at least one of the rotary shaft and the collar from rotating.

BRIEF DESCRIPTION OF THE DRAWINGS

The invention will be described below in accordance with the accompanying drawings, in which.

DETAILED DESCRIPTION OF THE PREFERRED EMBODIMENTS

Figure 1:
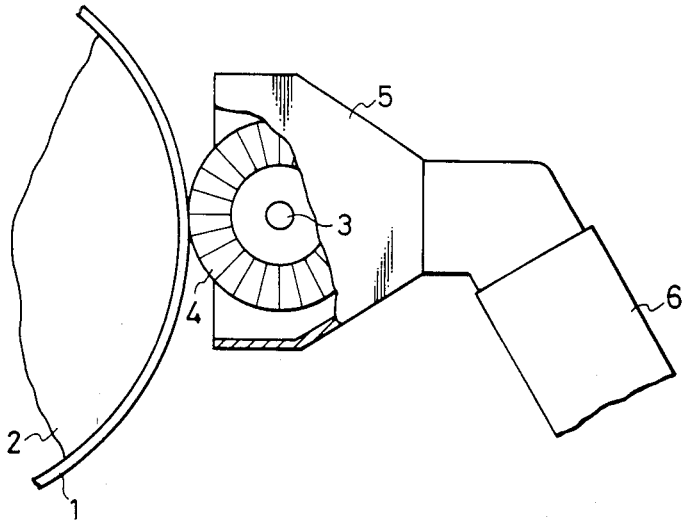
FIG. 1 is a side view showing a main part of the device according to the present invention.

In FIG. 1, a brush 4 is rotatably supported by a suction hood 5 through a rotary shaft 3 so as to be rotated while touching the outer periphery of a type-carrying belt 1 which is turned by a pulley 2. The suction hood 5 is connected to a suction device (not shown) through a hose 6. Ribbon dust or the like on the type-carrying belt 1 is scraped off by the brush 4 an sucked into the hood 5.

Figure 2:
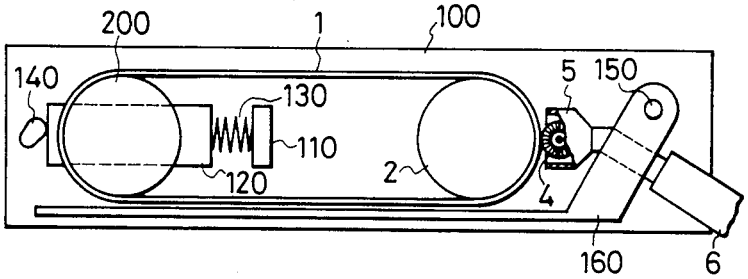
FIG. 2 is a plan view showing the positional relationship amoung the pulleys, the type-carrying belt, and the brush.

In FIG. 2, on a frame 100 for rotatably supporting a pair of pulleys 2 and 200, a sliding plate 120 rotatably supporting the pulley 200 is movably mounted. A spring 130 is provided between a right end of the sliding plate 120 and a projection 110 formed on the frame 100, so that the sliding plate 120 is urged to the left in the drawing. A cam 140 is rotatably mounted on the frame 100 to contact the left end of the sliding plate 120. The spring 130 urges the pulley 200 to the left in the drawing through the sliding plate 120 so as to give the type-carrying belt 1 a predetermined tensile force. When the cam 140 is rotated, the sliding plate 120, and hence the pulley 200, is urged to the right in the drawing against the spring 130, so that the type-carrying belt 1 may be loosened for replacement.

A ribbon separator 160 is mounted rotatably on the frame 100 about a pin 150 and horizontally extended in the longitudinal direction of the type-carrying belt 1. The separator 160 is provided to prevent a paper (not shown) from touching an ink ribbon during operations except printing and is necessarily used in common printers. However, the separator 160 becomes an obstacle when the ink ribbon or the type-carrying belt 1 is replaced and therefore it is rotatably attached on the frame 100 so as to be able to be separated from the frame 100. The suction hood 5 is mounted on the frame 100 so that the brush 4 supported by the suction hood 5 touches the type-carrying belt 1.

Figure 3:
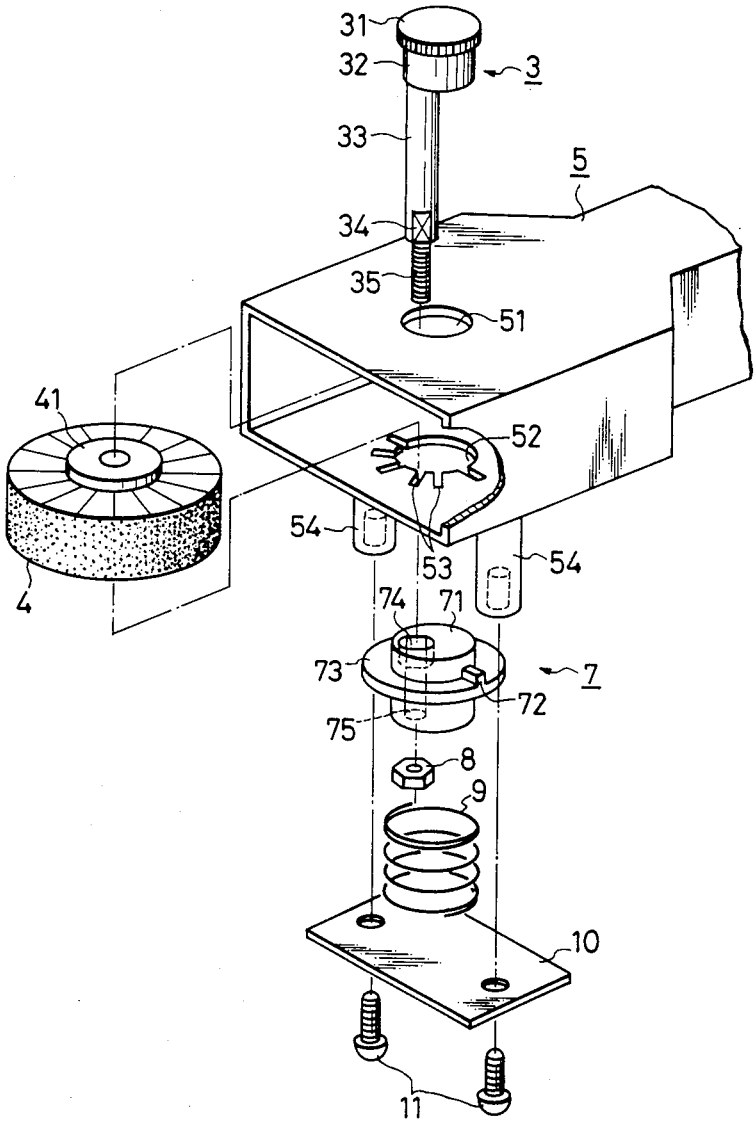
FIG. 3 is an exploded perspective view showing a main part of an embodiment of the present invention.
Figure 4:
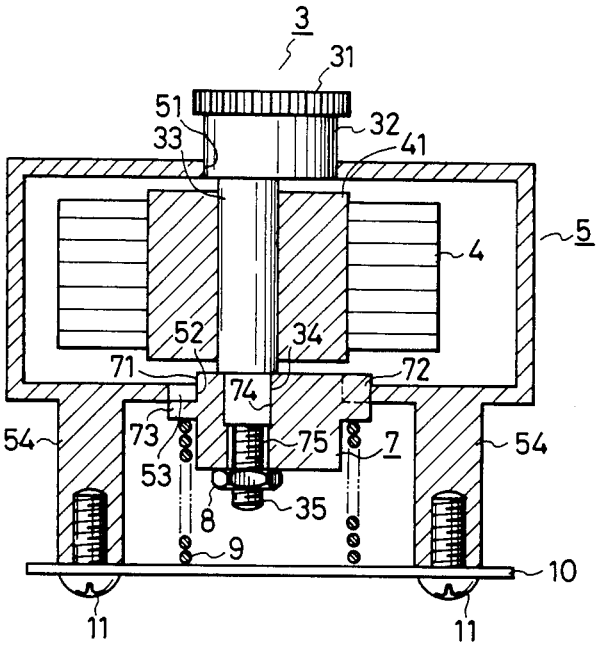
FIG. 4 is a cross section showing the invention as assembled.

In FIGS. 3 and 4, the rotary shaft 3 is constituted, from top to bottom in the Figures, by a knob portion 31, a positioning portion 32, an eccentric shaft portion 33 on which the brush 4 is attached, two phase registration flat surfaces 34, and a threaded portion 35.

In top and bottom walls of the suction hood 5, there are respectively formed a hole 51, into which the positioning portion 32 of the rotary shaft 3 is to be fitted, and another hole 52 having a plurality of radially extending slots 53 on its periphery. Two downwardly extending bosses 54, each of which has a threaded hole at its bottom portion, are formed on the bottom of the suction hood 5.

A collar 7 is provided with a positioning portion 71 fitted with the hole 52, and an engagement/locking portion 72 formed on a flange 73 and fitted into a desired one of the slots 53, the positioning portion 71 having a phase registration hole 74, with two flat surfaces 34, and formed at an eccentric position thereof. A circular hole 75 through which the threaded portion 35 of the rotary shaft 3 can pass but through which the eccentric shaft 33 cannot pass is formed in the positioning portion 71 so as to extend down from the phase registration hole 74. The collar 7 is fixed on the rotary shaft 3 by a nut 8 threaded onto the threaded portion 35 so as to be axially/radially movable together with the rotary shaft 3. The collar 7 is always urged upwardly against the suction hood 5 by a spring 9 provided between the collar 7 and a plate 10 fixed on the bosses 54 by screws 11. The brush 4 is provided with a support 41 having a center hole of a diameter which is slightly larger than that of the eccentric shaft 33.

In such an arrangement, if the brush 4 is caused to touch the type-carrying belt 1, the brush 4 is rotated smoothly about the eccentric shaft 33 to thereby clean the type-carrying belt 1. In this case, the engagement-/locking portion 72 of the collar 7 is fitted into a selected one of the slots 53 and cannot be released from this fitted state because it is urged by the spring 9 against the suction hood 5, so that the collar 7 and the rotation shaft 3 are prevented from rotating. That is, the brush 4 can be rotated at a desired position to clean the type-carrying belt 1.

If the rotary shaft 3 is rotated by grasping the knob portion 31 when the knob portion 31 is depressed to push down the rotary shaft 3 and the collar 7 against the spring 9 to release the engagement between the engagement/locking portion 72 and the selected one slot 53, the rotary shaft 3 and the collar 7 rotate about the coaxial centers of the respective positioning portions 32 and 71, so that the position of the eccentric shaft portion 33 formed eccentrically from the coaxial centers is changed to allow the brush 4 to move. Because there are a plurality of slots 53, the engagement/locking portion 72 can be fitted so that the brush 4 can be set at a desired position where the brush 4 can touch the type-carrying belt 1.

Thus, where the brush 4 becomes so abraded so as to be unable to touch the type-carrying belt 1, the displacement of the brush 4 in such a manner as described above enables the brush 4 to touch the type-carrying belt 1 again, so that the brush 4 need not be replaced as frequently.

Moreover, in this embodiment, when the type-carrying belt 1 is replaced, it is possible to move the brush 4 to separate from the type-carrying belt 1 prior to the replacement of the belt to keep the brush 4 and the pulley 2 separate, so that attachment and removal of the type-carrying belt 1 can be easily performed and ribbon dust can be prevented from adhering to the surface of the pulley 2.

Figure 5:
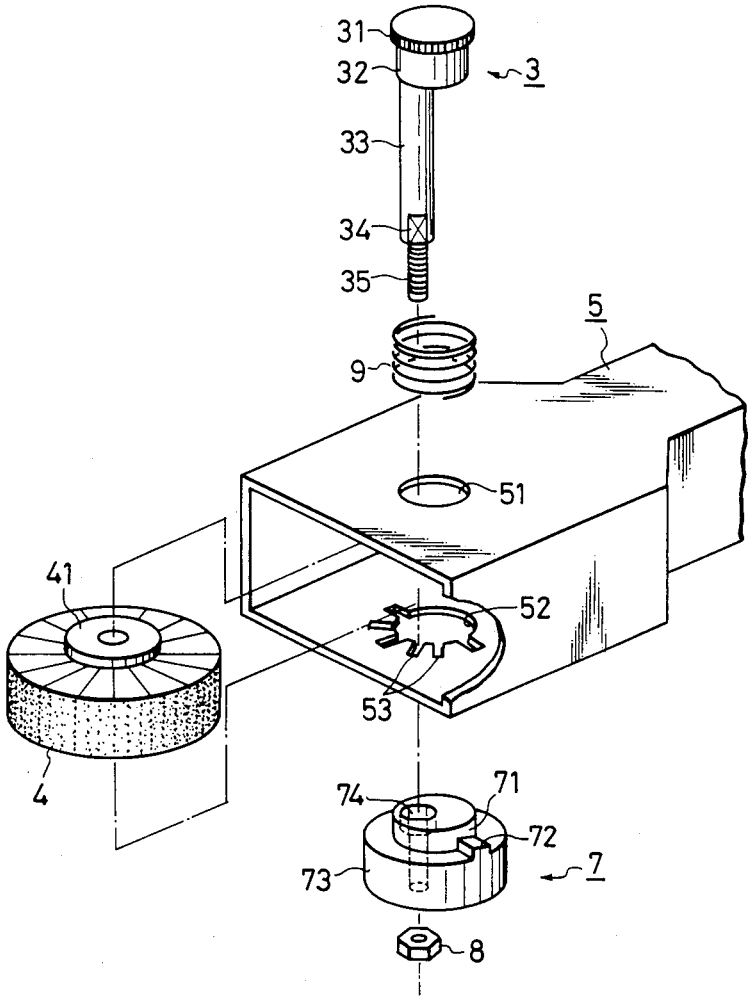
FIG. 5 is an exploded perspective view showing a main part of another embodiment according to the present invention.

Although the rotary shaft 3 and the collar 7 are arranged to be urged upwardly by the spring 9 provided under the suction hood 5 in the foregoing embodiment, the same effect can be obtained in the case where a spring 9 is provided between the knob portion 31 of the rotary shaft 3 and the upper surface of the suction hood 5 as shown in FIG. 5.

According to the present invention, it is possible to cause the brush always to touch the type-carrier by changing the position of the brush even when the brush has been worn out, so that the period of replacement of the brush can be extended. Further, it is possible to bring the brush and the type-carrier into a non-touching state by changing the position of the brush when the type-carrier is replaced, so that attachment and removal of the type-carrrier can be easily performed, the pulley can be prevented from touching the brush so that the former does not get dirty, and the type-carrying belt can be driven at a stable speed.

We claim:

1. In a type-carrier cleaning device for cleaning a type-carrier (1) supported by at least two pulleys (2,200) so as to be able to turn thereabout, said device including a brush (4) provided opposite one (2) of said pulleys with said type-carrier positioned therebetween, to thereby clean said type-carrier, and a suction hood (5) for rotatably supporting said brush, the improvement wherein said device further comprises:

a rotary shaft (3) passed through top and bottom portions of said suction hood and rotatably supported by said suction hood, said rotary shaft having an eccentric shaft portion (33) on which said brush is mounted, said rotary shaft extending through a hole (52) formed in said suction hood;

a collar (7) securely fitted to a lower end (35) of said rotary shaft below said bottom portion of said suction hood;

a plurality of engagement/locking slots (53) extending radially outward from a periphery of the hole (52), said slots being formed in said suction hood at various rotational angeles around the hole with respect to an axis of said rotary shaft; and an engagement/locking member (72), formed on a portion of said collar which engages with said suction hood at the hole, for engaging and disengaging with one of said engagement/locking slots as desired to thereby prevent said collar and said rotary shaft form rotating, said engagement/locking member being movable to a desired position for engaging with said one of said slots by rotating said rotary shaft when said engagement/locking member is disengaged, and said brush being moved relative to said type-carrier when said rotary shaft is rotated, whereby said brush may be selectively positioned more closely to said type-carrier as said brush is abraded, in accordance with the engagement/locking slot selected.

2. A type-carrier cleaning device as claimed in claim 1, further comprising a plate (10) attached to said suction hood below said collar, and spring means (9), positioned between said plate and said collar, for urging said collar upwardly in the axial direction of said rotary shaft against said suction hood to normally engage said engagement/locking member with said one of said engagement/locking slots.

3. A type-carrier cleaning device as claimed in claim 2, wherein said engagement/locking member is brought out of engagement with said one of said engagement-/locking slots by application of a force against the force of said spring means.

4. a type-carrier cleaning device as claimed in claim 1, wherein said rotary shaft has a knob portion (31), wider than the rest of said rotary shaft, at an upper end thereof, said device further comprising spring means, positioned between said upper portion of said suction hood and said knob portion, for urging said rotary shaft upwardly in the axial direction of said rotary shaft to normally engage said engagement/locking member with said one of said engagement/locking slots.

5. A type-carrier cleaning device as claimed in claim 1, wherein said rotary shaft has a threaded portion at a bottom portion thereof, said device further comprising a nut 8, fitted onto said threaded portions, for fixing said collar onto said rotary shaft.

6. A type-carrier cleaning device as claimed in claim 1, wherein said rotary shaft and said collar have respective phase registration portions (34,74) which engage with each other to enable said rotary shaft and said collar to turn together.

7. A type-carrier cleaning device as claimed in claim 1, further comprising securing/releasing means (110,120,130,140) for normally urging said type-carrier tightly against said pulleys, and for loosening said type-carrier for removal.

8. A type-carrier cleaning device as claimed in claim 7, wherein said securing/releasing means comprises a sliding plate (120) for rotatably supporting one of said at least two pulleys, and biasing means (110,130) for normally urging said sliding plate away from the other of said at least two pulleys whereby said type-carrier is tightly fitted around said at least two pulleys, said sliding plate being urgeable against a force of said biasing means for loosening said type-carrier for removal.

9. A type-carrier cleaning device as claimed in claim 8, wherein said securing/releasing means further comprises a rotatable cam (140) disposed in contact with said plate and rotatable to a first position for urging said plate against the force of said biasing means.

10. A type-carrier cleaning device as claimed in claim 1, wherein said brush is moved against a portion of said type-carrier which is in contact with said one of said pulleys.

* * * * *